US005731072A

United States Patent [19]

Schamesberger

[11] Patent Number: 5,731,072

[45] Date of Patent: Mar. 24, 1998

[54] CONTINUOUS PROCESS FOR PRODUCING A DECORATED SKI COATING MATERIAL

[75] Inventor: Robert Schamesberger, Eisenstadt, Austria

[73] Assignee: Isosport Verbundbauteile Gesellschaft m.b.H., Austria

[21] Appl. No.: 583,007

[22] PCT Filed: Jun. 1, 1995

[86] PCT No.: PCT/AT95/00113

§ 371 Date: Jan. 26, 1996

§ 102(e) Date: Jan. 26, 1996

[87] PCT Pub. No.: WO95/32771

PCT Pub. Date: Dec. 7, 1995

[30] Foreign Application Priority Data

Jun. 1, 1994 [AT] Austria ..... 1125/94

[51] Int. Cl.[6] ..... B32B 7/02

[52] U.S. Cl. ..... 428/220; 427/374.1; 428/245; 428/339; 428/364; 428/500; 526/352; 526/73; 264/462; 264/25

[58] Field of Search ..... 428/500, 364, 428/220, 245, 339; 264/462, 25; 526/352, 73; 427/374.1

[56] References Cited

U.S. PATENT DOCUMENTS

| | | | |
|---|---|---|---|
| 4,462,852 | 7/1984 | Custor | 156/231 |
| 4,933,127 | 6/1990 | Guiguet | 264/80 |

FOREIGN PATENT DOCUMENTS

| | | |
|---|---|---|
| 60 243 | 8/1991 | Austria . |
| 3 004 518 | 8/1981 | Germany . |
| 81/03462 | 12/1981 | WIPO . |

*Primary Examiner*—E. Rollins Buffalow

*Attorney, Agent, or Firm*—Bacon & Thomas

[57] ABSTRACT

A continuous process is disclosed for producing a strip of decorated ski coating material from ultra-high molecular weight polyethylene. A 0.5 to 1.5 mm thick strip of ski coating material produced in a screw-type or piston-type extruding machine or by sintering followed by peeling and printed with thermodiffusion dyes continuously runs through a heating zone in which it is uniformly heated up to a temperature above 140° C., so that the crystalline structure of the ultra-high molecular weight polyethylene is partially decomposed and the thermodiffusion dye diffuses into the molten ski coating material without the need for an intermediate carrier. The ski coating material provided with the thermodiffusion dye then runs through a cooling zone in which it is uniformly cooled down to a temperature equal to or lower than ambient temperature, so that 25% to 60% of the ultra-high molecular weight polyethylene crystallizes and the thermodiffusion dye is fixed on the ultra-high molecular weight polyethylene during cooling.

13 Claims, 1 Drawing Sheet

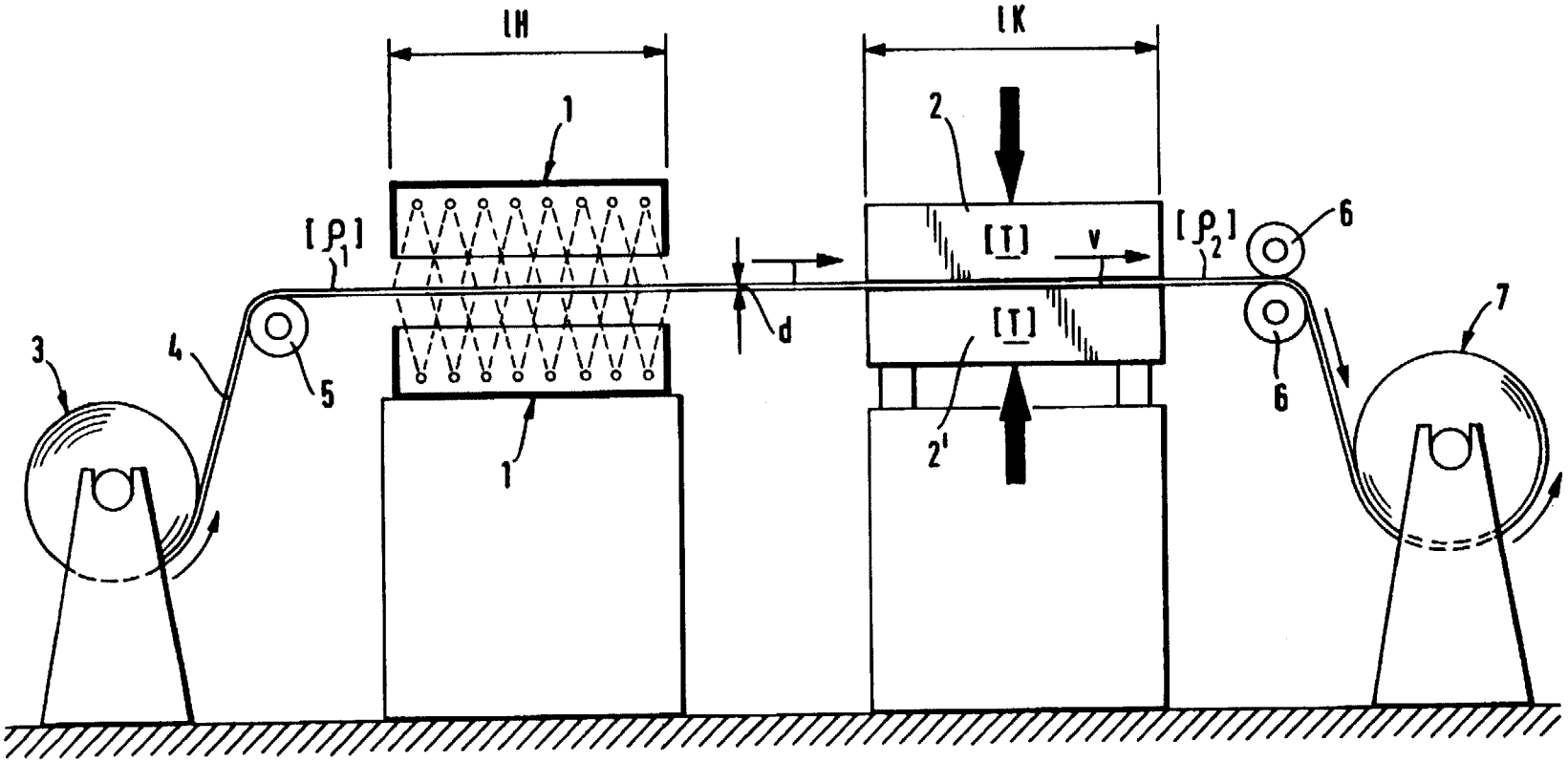
7
6
6
[P2]
IK
2
[T]
v
[T]
2'
d
IH
1
1
[P1]
5
4
3

CONTINUOUS PROCESS FOR PRODUCING A DECORATED SKI COATING MATERIAL

The invention relates to a continuous process for producing a strip of decorated material for applying to a ski made of ultra-high molecular weight polyethylene.

STATE OF THE ART

It is known to provide ski parts and ski-coating materials made of polyethylene with a decoration according to the process of screen printing. Thereby, the screen printed color is molded onto the ski-coating material through a pattern fabric, which has color-permeable zones as well as color-impermeable zones in accordance with the desired decoration pattern. Thereafter, the leftover dye parts are removed with a blade.

It is now required of a decorated ski-coating material according to the process, that the screen printed colors be also well in view on the backside of the coating material which faces the snow and thereby also facing the observer, because the bonding with the rest of the ski parts is performed on the printed side. However, it has been shown that the color intensity of the decoration is negatively influenced by the milk-white appearance of the polyethylene so that the decoration is not clearly visible to the observer.

Furthermore, it is known from AT-PS 362 691 to provide the surface of a ski with a decoration made of plastic through the process of press transfer. Thereby, the thermodiffusion colors are applied like paper on an intermediate carrier and the plastic is pressed hot thereon, whereby the colors go into the gaseous or melting phase and penetrate into the plastic. This process could be applied also to the decoration of ski coatings; however, this is insofar costly since high demands like high dimension stability and good stamping work characteristics are required of the intermediate carrier as well as surface characteristics which prevent the extended penetration of the pressing color into the papers printed with thermodiffusion dyes, so that a high output of dye on the printed plastic is obtained. Further, the intermediate carriers must be affixed onto the printed plastic as well as the ski coating in further process steps and must be removed after stamping. After their use, the intermediate carriers must be discarded since they cannot be used again in a further process step.

Besides the requirements for the decoration as well as for its manufacture on the ski coating, the coating must also show the needed physical properties such as a high resistance to wear by friction as well as a good absorption for wax. From WO-A1-93/05853 it is known, that the resistance to wear by friction of the ski-coating material can be determined through the molecular weight of the polyethylene, so that the use of ultra-high molecular weight polyethylene becomes necessary.

Since the wax absorption depends from the thickness of the UHWPE, and therefore from the crystalline portion in the ultra-high molecular weight polyethylene, the polyethylene is set through targeted crystallization to the highest wax absorption according with the process of WO-A1-93/05853.

DESCRIPTION OF THE INVENTION

The object of the invention is, therefore, to provide a color intensive decoration on a ski-coating material made of ultra-high molecular weight polyethylene in a easy realizable process, whereby the decorated ski-coating material has a high wax absorption as well as a good resistance to wear by friction.

According to the invention, it is suggested here to produce a strip of ski-coating material made of ultra-high molecular weight polyethylene and to provide the same with a decoration in such a manner that a strip of ski-coating material made by screw-type extrusion, piston-type extrusion or sintering followed by peeling and with a thickness of approximately 0.5 to 1.5 mm is later printed with a thermodiffusion dye and runs continuously through a heating zone in which it is heated to a even temperature of 140° C., so that the crystalline structure of the ultra-high molecular weight polyethylene partially breaks up and the thermodiffusion dye penetrates into the molten ski-coating material without additional help from an intermediate carrier, and so that the ski-coating material provided with the thermodiffusion dye further passes through a cooling zone in which the material is evenly cooled at the same or a lower temperature than the ambient temperature, so that during the cooling the ultra-high molecular weight polyethylene is transferred to a crystalline portion of 25% to 60% and the thermodiffusion dye can be fixed on the ultra-high molecular weight polyethylene.

Additional advantages of the invention consist in that the strip of ski-coating material printed by thermodiffusion dye is heated in the heating zone by means of an infrared radiation of between 10 and 25 seconds, preferably 13 to 20 seconds, and thereafter, in the cooling zone which is formed in part by a cooled down calibration means, it is cooled to a temperature of 10° to 20° C. and the time in which the strip of ski-coating material printed with the thermodiffusion dye remains in the cooling zone is from 8 to 30 seconds, preferably 10 to 25 seconds.

The strip of ski-coating material printed with the thermodiffusion dyes according to the process of the invention is used for the manufacture of downhill skis, cross country skis and snowboards.

BRIEF DESCRIPTION OF THE DRAWING AND EXEMPLARY EMBODIMENTS OF THE INVENTION

The invention will now be described in more detail with reference to the single FIGURE and through exemplary embodiments.

The FIGURE shows a schematic of a device in side view for the practice of the process of the invention comprising a heating zone (1) and a cooling zone with the calibrating plates (2, 2').

The process according to the invention will be explained with reference to generally known work regulations:

The ski-coating material 4, which was provided with the thermodiffusion dye was manufactured according to a known arrangement of screw-type extrusion, piston-type extrusion, or sintering and later was printed by means of a screen printing or flexographic printing or gravure printing process with the thermodiffusion colors, is removed from the storage roll 3, directed over the deviation roll 5 and with the speed v m/rain is guided to the heating zone (1), which can be provided with an IR heating element, for example. In the heating zone, which has the length l(H), the ultra-high molecular weight polyethylene melts at a temperature of 140° C. The extent of the crystal structure breakup depends on the dwell time of the ski-coating material in the heating zone which is proportional to the length l(H). Also dependent on the dwell time is the extent of the sublimization and/or melting of the color pigments in the thermodiffusion dye which, as a consequence, diffuse into the ski-coating material. This result is accomplished without additional help from an intermediate carrier for the thermodiffusion dye as it is known, for example, from AT-PS 362 691. Then, the molten ski-coating material passes through the cooling zone which is comprised by two calibration plates (2, 2'). These have the object of giving the molten material a shape and, at the same time cooling it, as well as fixing the thermodiffusion dye onto the ski-coating material. During the cooling, the ultra-high molecular weight polyethylene crystallizes; this result also depends on the dwell time of the ski-coating material, which is proportional to the length of the cooling zone 1(K). Afterward, the cooled down ski-coating material passes by the pair of exit rollers 6 and is then rolled up onto the storage roll 7.

Thereby, with the help of the process according to the invention, the grade of crystallization of the ultra high molecular weight polyethylene of a ski-coating material manufactured in a known manner can be controlled, whereby the ski-coating material possesses optimal resistance to wear by friction and wax absorption as well as optimal sliding behavior on the snow and, on the other hand, through the addition of the thermodiffusion dye, whereby it can provide a color-intensive decoration on the ski-coating material.

Useful Commercialization

The ski-coating material manufactured with the process according to the invention is used on downhill and cross country distance skis and snowboards.

I claim:

1. Continuous process for producing a decorated strip of ski-coating material made of ultra-high molecular weight polyethylene comprising producing the strip of ski-coating material by screw extrusion, piston extrusion, or sintering followed by peeling of a thickness of 0.5 to 1.5 mm, printing said strip of ski-coating material with thermodiffusion dyes, directing said printed strip continuously through a heating zone in which it is heated at a constant temperature of 140° C. so that the crystal structure of the ultra-high molecular weight polyethylene partially breaks up and the thermodiffusion dye can penetrate into the molten ski-coating material without the aid of an intermediate carrier, and substantially directing said printed strip continuously through a cooling zone, in which it is cooled at the same or lower temperature than the ambient so that, during the cooling process, the ultra-high molecular weight polyethylene is transferred into a crystalline portion of 25% to 60% and the thermodiffusion dye is fixed to the ultra-high molecular weight polyethylene.

2. Process according to claim 1 wherein the strip of ski-coating material printed with thermodiffusion dyes is a ski-coating material printed using a screen printing process.

3. Process according to claim 1 wherein the strip of ski-coating material printed with thermodiffusion dyes is a ski-coating material printed using a flexographic printing process.

4. Process according to claim 1 wherein the strip of ski-coating material printed with thermodiffusion dyes is a ski-coating material printed using a gravure printing process.

5. Process according to claim 1 wherein the strip of ski-coating material printed with thermodiffusion dyes is heated in the heating zone by means of infrared radiation.

6. Process according to claim 1 wherein the strip of ski-coating material printed with thermodiffusion dyes is heated between 10 and 25 seconds.

7. Process according to claim 1 wherein the strip of ski-coating material printed with thermodiffusion dyes is cooled to a temperature of 10° to 20° C. in the cooling zone, which is formed, at least partially, by cooled calibration means.

8. Process according to claim 1 wherein the dwelling time of the strip of ski-coating material printed with thermodiffusion dyes in the cooling zone is 8 to 30 seconds.

9. A downhill ski comprising the strip of ski-coating material printed with thermodiffusion dyes produced in accordance with claim 1.

10. A cross country ski comprising the strip of ski-coating material printed with thermodiffusion dyes produced in accordance with claim 1.

11. A snowboard comprising the strip of ski-coating material printed with thermodiffusion dyes produced in accordance with claim 1.

12. Process according to claim 6 wherein the strip of ski-coating material printed with thermodiffusion dyes is heated between 13 to 20 seconds.

13. Process according to claim 8 wherein the dwelling time of the strip of ski-coating material printed with thermodiffusion dyes in the cooling zones is 10 to 25 seconds.

* * * * *